United States Patent [19]

Hoskin

[11] 4,284,112

[45] Aug. 18, 1981

[54] AUTOMATIC WOOD CUTTING AND SPLITTING MACHINE

[76] Inventor: Charles E. Hoskin, 8824 20th N.E., Seattle, Wash. 98115

[21] Appl. No.: 860,390

[22] Filed: Dec. 14, 1977

[51] Int. Cl.[3] ..... B27L 7/00

[52] U.S. Cl. ..... 144/3 K; 83/370; 144/193 A

[58] Field of Search ..... 144/3 K, 193 R, 193 A; 83/369, 370

[56] References Cited

U.S. PATENT DOCUMENTS

| | | | |
|---|---|---|---|
| 2,623,587 | 12/1952 | Herrey | 83/370 X |
| 2,925,107 | 2/1960 | Fitzwater | 144/246 R |
| 3,596,691 | 8/1971 | Broadfoot | 144/193 A |
| 3,862,651 | 1/1975 | Heikkinen | 144/31 K |
| 3,974,867 | 8/1976 | Butas, Jr. | 144/193 A |
| 4,076,061 | 2/1978 | Greeninger | 144/3 K |
| 4,173,237 | 11/1979 | Heikkinen et al. | 144/193 A |

FOREIGN PATENT DOCUMENTS

| | | | |
|---|---|---|---|
| 233927 | 5/1961 | Australia | 144/193 A |

*Primary Examiner*—W. Donald Bray

*Attorney, Agent, or Firm*—Seed, Berry, Vernon & Baynham

[57] ABSTRACT

An automated machine is disclosed which accepts a whole log, cuts it into predetermined lengths, splits each length in half and conveys the split log to a stacking location. A single person can operate the machine.

10 Claims, 7 Drawing Figures

AUTOMATIC WOOD CUTTING AND SPLITTING MACHINE

BACKGROUND OF THE INVENTION

1. Field of the Invention

This application relates to equipment for cutting, splitting and conveying timber for firewood or other use and, more particularly, to automated and improved equipment for doing so.

2. Description of the Prior Art

Machines for sawing and splitting timber are known. U.S. Pat. No. 3,862,651, for example, discloses a machine which utilizes an endless chain conveyor to advance timber to a cutting position where it is cut by a chain saw. The cut log falls into a V-shaped trough wherein a hydraulic ram forces the cut timber against a splitting wedge to split the timber into two pieces. Other combined wood sawing and splitting machines are disclosed in U.S. Pat. Nos. 1,441,996; 1,001,272; and 1,598,695. U.S. Pat. No. 3,640,323 also discloses a machine for splitting and chopping timber.

SUMMARY OF THE INVENTION

The present invention comprises a machine which can accept timber, advance the timber to a cutting position, cut the timber into predetermined lengths, split the cut timber in half and convey the split timber to a stacking location. Operation of the machine is automated so that one person can operate it. The machine utilizes improved conveying and hold-down means for holding the timber while it is conveyed into cutting position and also utilizes improved splitting means allowing the split timber to be conveyed to a stacking location. A further aspect of the invention is in the use of a hydraulic driven chain saw for cutting the timber. A still further aspect of the invention is the provision of control means for automating operation of the machine.

DESCRIPTION OF THE PREFERRED EMBODIMENTS

Figures 1, 2:
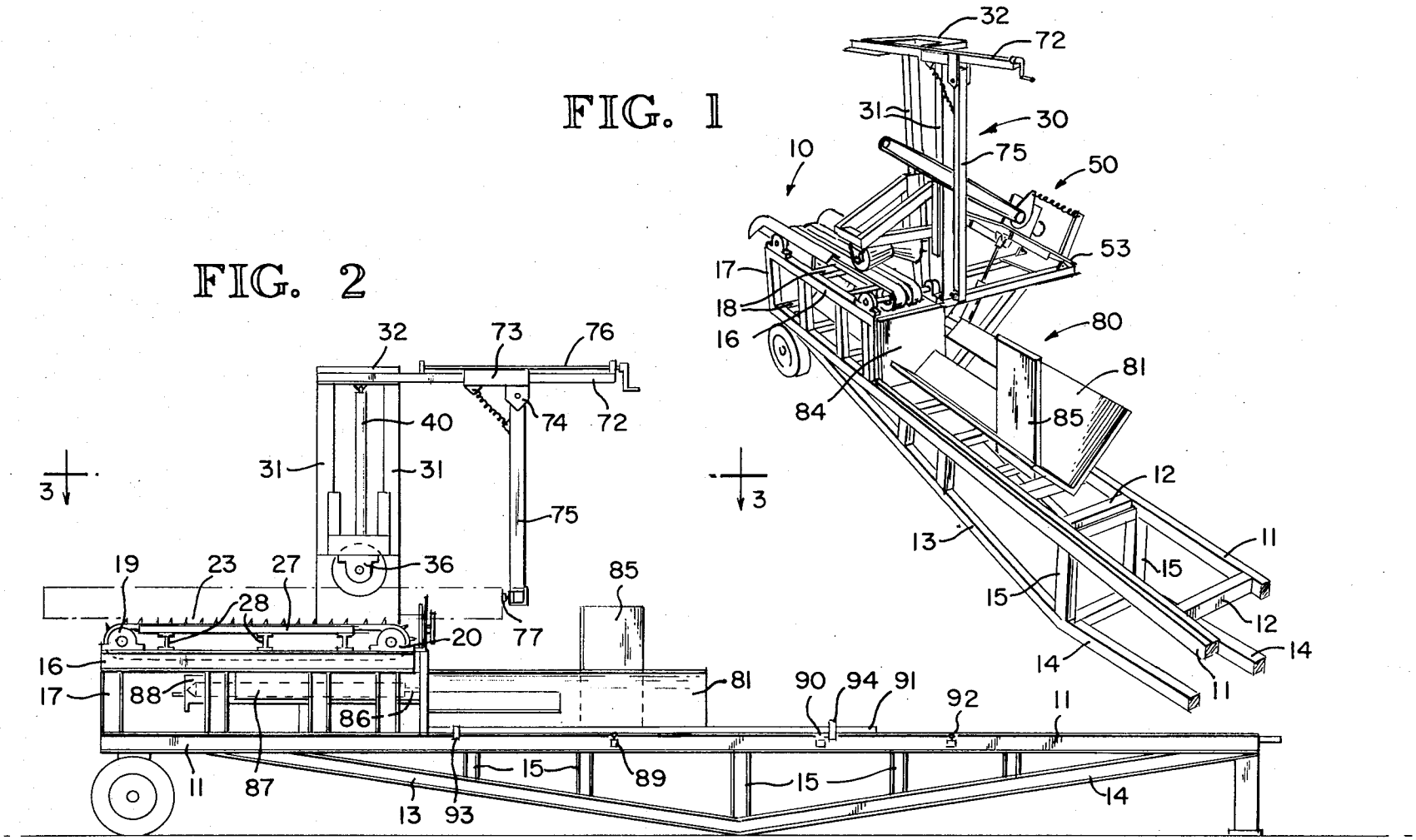
FIG. 1 is a perspective view of the automated equipment described herein.
FIG. 2 is a side elevational view of the equipment of FIG. 1.

Referring to FIG. 1 the equipment shown for automatically measuring, cutting, splitting and conveying timber for firewood comprises support and conveying means 10 for conveying de-limbed timber to a cutting station, means 30 to hold the timber being conveyed for cutting, cutting means 50 for cutting the timber into sections of predetermined length at the cutting station, splitting means 80 for splitting the cut timber and control means for controlling sequenced operation of the equipment.

Referring to FIG. 1 support and conveying means 10 supports the equipment either on the ground or on wheels so that the equipment is portable and can be readily moved from location to location. The frame structure includes a pair of spaced horizontal beams 11 extending the full length of the equipment, the spaced beams connected at spaced intervals along their length by cross members 12. A truss structure made up of spaced beams 13 and 14 are secured to the respective ends of the horizontal beams 11. The truss beams 13 and 14 intersect with each other at about the midpoint of the length of the horizontal beam 11 as illustrated. Vertical supports 15 connect the horizontal support beams 11 and the truss beams 13 and 14 at spaced intervals.

A conveyor support frame is secured to one end of the beams 11 and includes a pair of horizontal spaced beams 16 extending parallel to and elevated above the horizontal beams 11 the length of the conveyor. The horizontal support beams 16 are secured to the horizontal beams 11 by spaced vertical supports 17 and secured to each other by cross supports. Pairs of pillow blocks 19 and 20 are secured, respectively, to each end of the horizontal beams 16 as illustrated in FIG. 2. The pillow blocks 19 and 20 receive and support respective shafts 21 and 22 for rotation. Mounted on each of the shafts 21 and 22 are spaced pairs of sprockets. Respective endless conveyor chains 23 are trained about the pairs of sprockets as illustrated. The conveyor is driven by suitable power means controlled as will be described with reference to FIG. 7. The conveyor chains are illustrated in detail in FIG. 4 and comprises respective chain links 24 connected by connectors 25 as illustrated. Upstanding dogs 26 are secured to the chain links at desired intervals, each of the dogs 26 having a sharp terminating upper edge which grasp the timber laid on the conveyor and move it in the direction of movement of the conveyor chains. Each of the conveyor chains is supported between the pairs of sprockets elongated supports 27 which rest on I beams 28. A pair of parallel guides or fenders 29 are secured above the plane of the conveyor and adjacent the conveyor chains to serve as guides for the timber being introduced to the in-feed end of the conveyor.

Figures 3, 4, 5:
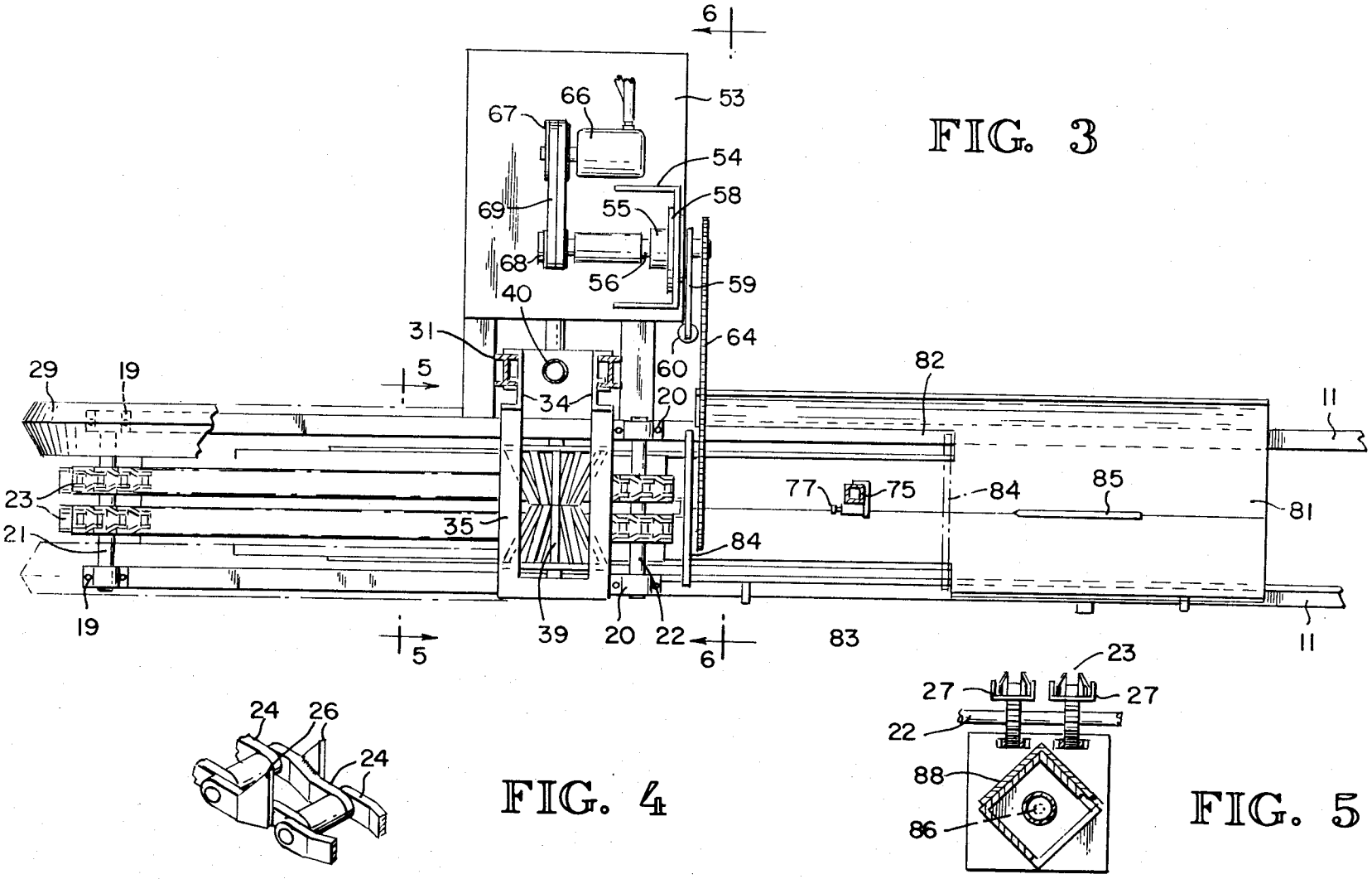
FIG. 3 is a plan view of the equipment of FIG. 1.
FIG. 4 is a partial perspective view of one of the conveyor chains used to convey the timber to the cutting station.
FIG. 5 is a vertical cross section along 5—5 of FIG. 3.
Figure 6:
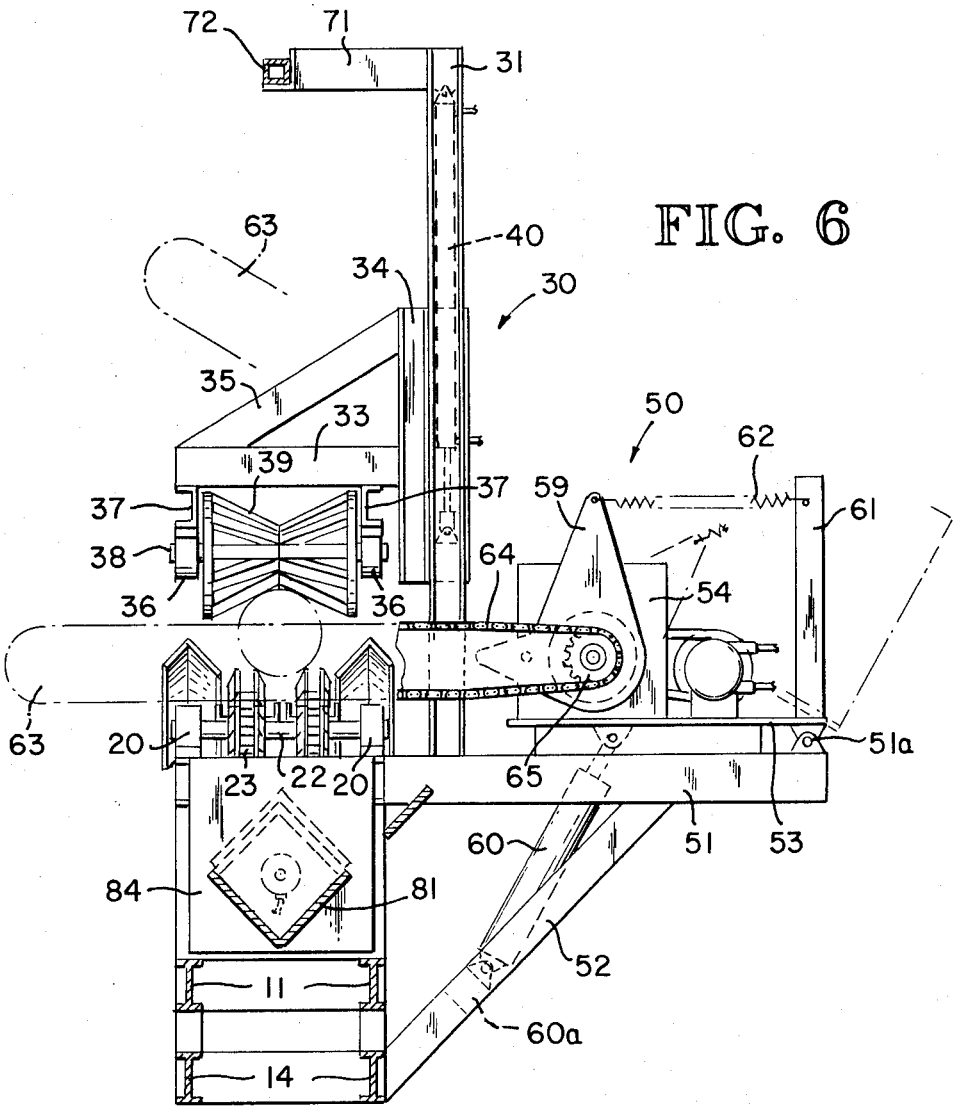
FIG. 6 is a vertical cross section along line 6—6 of FIG. 3.

It is necessary, in order to insure proper operation of the cutting means, to hold the log securely during the cutting operation. This is done by the hold-down means 30 located near the out-feed end of the conveying means. The hold-down means is supported by a frame which is vertically displaceable along vertical support beams 31 secured at their lower ends to the support frame 10. The upper end of the vertical support beams 31 are connected by cross support 32. The frame for the hold-down means comprises a pair of horizontal beams 33 secured to a pair of vertical channel beams 34 which, as illustrated in FIG. 3, are adapted to slide vertically along the vertical I-beams 31. The horizontal supports 33 are reinforced by supports 35. A pair of pillow blocks 36 secured to spaced supports 37 secured to the underside of beams 33 support shaft 38 for rotation. A hold-down wheel 39 is mounted on the shaft to engage the upper surface of timber introduced to the in-feed end of the conveyor to hold the timber secure against the conveyor surface during the cutting operation. A pneumatic cylinder 40 is pivotally secured to the upper horizontal cross support 32 as illustrated in FIG. 2. The piston of the pneumatic cylinder is secured to the vertically adjustable frame supporting wheel 39 as illustrated in FIG. 6. The piston of the pneumatic cylinder is manually operated to hold a timber introduced onto the conveyor by engaging the upper surface of the timber with the wheel 39. As the timber is cut into predetermined lengths the conveyor intermittently advances the timber. The wheel riding along the surface of the timber maintains the timber in contact with the conveyor; however, the pneumatic cylinder allows the wheel 39 to move up and down within limits to compensate for irregularities in the surface of the timber being cut and the changing diameter of the timber as it proceeds through the equipment. The pneumatic cylinder is used in preference to other means which do not have sufficient flexibility and which have to be disengaged from the timber each time the timber is moved forward.

The cutting means 50 for cutting the timber introduced into the equipment into predetermined lengths for firewood or other purposes is best illustrated in FIG. 6. The cutting means is a hydraulically driven chain saw mounted on a platform which is automatically lowered to cut the timber on the conveyor at predetermined intervals and then raised for advance of the timber to a new position for a subsequent cut. FIGS. 3 and 6 best illustrate the cutting means. The cutting means is supported by a pair of spaced horizontal beams 51 secured at one end to one of the horizontal support beams 11. The beams 51 are reinforced by a pair of spaced supports 52. A platform 53 is pivotally connected to the support beam 51 at pivot point 51*a*. The platform 53 and the chain saw supported thereon are moved vertically to raise the saw to the position shown in FIG. 1 and in phantom in FIG. 6 by hydraulic cylinder 60 whose piston is pivotally secured to the underside of the platform 53. The cylinder 60 is secured to a cross beam 60*a* extending between spaced supports 52. Secured to the platform is a vertical chain saw support plate 54. A pillow block 55 secured to the platform 53 adjacent the support plate 54 supports a saw shaft 56 which extends through an opening in the support plate 54. The shaft is journalled in bearings secured to the support plate by a plate 58. A saw plate 59 is secured to shaft 56 on the side of the support plate 54 opposite the pillow block 55. The plate 59 is connected at its upper end to vertical support 61 by a tension spring 62 running between the plate 58 and the vertical support 61. An elongated chain saw bar 63 is secured to and extends from plate 59 as illustrated in FIG. 6. A saw chain 64 is trained around the chain bar 63 and sprocket 65 secured to shaft 56. A hydraulic motor 66 is mounted on the platform 53 adjacent the pillow block 55 as illustrated in FIG. 4. Pulley 67 is secured to the output shaft of the hydraulic motor 66 and is connected to pulley 68 secured to the shaft 56 by one or more belts 69.

Referring to FIG. 2 length sensing means 70 are employed to sense the length of timber being conveyed beyond the cutting station for stopping the conveyor when the desired length is reached. The length sensing means is adjustable to handle various lengths of timber. Referring to FIGS. 2 and 6 the length sensing means includes a pair of horizontal support beams 71 extending laterally from the vertical support beams 31 of the hold-down means. An extension beam 72 is secured to support beams 71, the beam 72 extending in the direction of the movement of the conveyor a distance sufficient to accomodate the various lengths of logs desired. A slidable sleeve 73 is adjustably secured over the extension beam 72. The sleeve has a downwardly extending flange 74 secured thereto to which a vertical member 75 is pivotably secured. The terminating end of member 75 extends downwardly far enough to be directly in the path of the timber being conveyed. The sleeve 73 is adjustable along the length of the extension 72 by a worm gear adjustment means 76 which may be manually operated. At the terminating end of member 75 is a limit switch 77 which is depressed by a forward traveling timber contacting the switch. As illustrated in FIG. 2 the member 75 is pivotally secured to sleeve 73. Member 75 may be spring-loaded, if desired, to allow a log to deflect and by-pass the member 75 should the conveyor fail to stop.

The timber cut by the cutting means is split by suitable splitting means 80 as will be described. The timber cut by the chain saw falls into a V-shaped trough 81 located directly beneath the cutting means, the trough extending in the direction of travel of the conveyor. The length of the trough may be as long as desired. An extension may be connected to the trough so that as the wood is split, it is then conveyed to a stacking location such as onto the bed of a flat bed truck or such other means. As will be noted in FIGS. 1 and 3 the trough adjacent the cutting means includes, on one side, a slot 82 and on the other side thereof a cutout portion 83. The purpose for these will be described shortly. At the end of the V-shaped trough adjacent the cutting means is a vertical pusher plate 84. The pusher plate has a V-shaped cutout therein corresponding to the configuration of the V-shaped trough 81 so that the pusher plate is free to travel along the V-shaped trough toward the splitting blade 85. The purpose of the slot 82 and cutout section 83 in the V-shaped trough 81 is to allow the pusher plate 84 to travel along the length of the slot and cutout portion as illustrated in FIG. 3. FIG. 3 illustrates the retracted and forward positions of the pusher plate 84. Downstream from the forward position of the pusher plate and extending vertically from the bottom of the V-shaped trough is a vertical splitter blade 85. Contrary to wedge-shaped means for splitting timber which have been utilized previously, the splitting blade utilized herein has substantially parallel sides in order not to force the timber, when split, over the sides of the V-shaped trough. The optimum thickness of the splitter blade has been determined to be about $\frac{3}{8}$ of an inch. Thinner blades do not stand up well under pressure to which they are subjected and thicker blades tend to force the split wood out over the V-shaped trough onto the ground. The rear of the pusher plate 84 is secured to the piston 86 of a hydraulic cylinder 87. The hydraulic cylinder is secured to the frame 10 beneath the conveyor as illustrated in FIG. 2 and is shielded by a shield 88 extending the full length of the hydraulic cylinder. The function of limit switches 89, 90 and 92, located as illustrated in FIG. 3 will be described hereafter.

Figure 7:
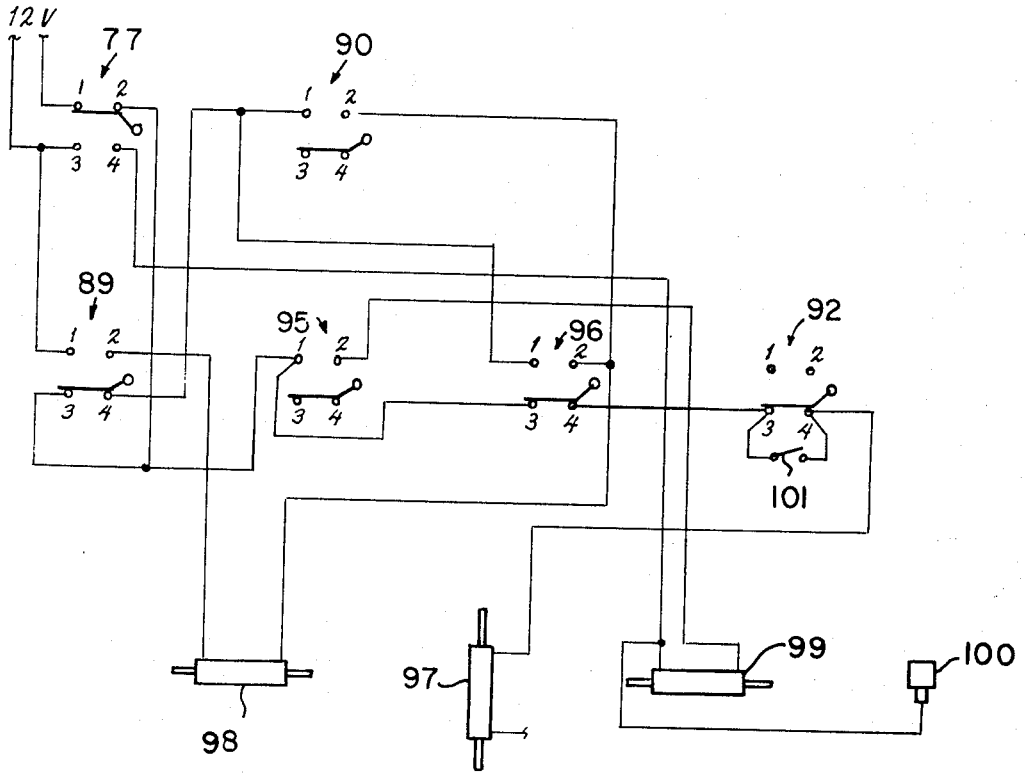
FIG. 7 is a hydraulic/electric schematic diagram of the control system for automation of the equipment described.

FIG. 7 illustrates the hydraulic electrical schematic system for control of the equipment. The sequence of operation of the unit is as follows. An operator positions a log on the in-feed end of the conveyor and actuates the conveyor by manual means. The log is held against the conveyor by manually lowering the hold-down wheel 39 against the log.

Referring to FIG. 2 a rod 91 is secured at one end to pusher plate 84, the rod traveling along the upper surface of beam 11. The rod includes adjustable projecting members 93 and 94 along its length as illustrated in FIG. 2 which are adjusted to contact the lever arms of switches 89, 90 and 92, the function of which will be described hereafter.

Referring to FIG. 7, when the mill is in the position illustrated in FIG. 1 with no log on the conveyor, the contacts 1 and 2 of switch 77 are closed. With the saw in the "up" position contacts 1 and 2 of switch 95 and contacts 1 and 2 of switch 96 are open. Switch 95 and 96 are located beneath the platform 53 and are activated by raising and lowering of the saw platform by the hydraulic cylinder 60. With the saw in the "up" position current bypasses switch 95 and flows through contacts 3 and 4 of switch 96 to activate hydraulic valve 97 to activate the motor driving the conveyor. Current also is routed through contacts 1 and 2 of switch 89 to hydraulic valve 98 to maintain the hydraulic cylinder 87 in retracted position; thus maintaining the pusher plate in retracted position as illustrated in FIG. 1.

When a log is placed on the conveyor and is advanced to strike switch 77 on the terminal end of vertical support 75 as illustrated in FIG. 2 contacts 3 and 4 of switch 77 are closed stopping the conveyor and activating hydraulic valves 99 and 100 which, respectively, control cylinder 60 to allow the saw to begin descent and start the hydraulic motor powering the saw. When the saw cuts through the log and is in the "down" position contacts 1 and 2 of switch 96 are closed allowing current flow to activate hydraulic valve 98 to extend the piston of ram 87 and the pusher plate secured thereto to split the log which has fallen into the V-shaped trough. As soon as the piston of cylinder 87 begins extension contacts 1 and 2 of switch 90 are closed by the projection 94 on rod 91 releasing the lever arm or switch 90. The piston reverses when the projection 93 on rod 91 trips switch 89 to open contacts 3 and 4 and close contacts 1 and 2. The saw in the "down" position also closes contacts 1 and 2 of switch 95. When the log falls into the trough after being cut by the saw, switch 77 reverts back to the position illustrated in FIG. 7 with contacts 1 and 2 closed allowing current through contacts 1 and 2 of switch 95 to hydraulic valve 99 to initiate raising of the saw platform by power cylinder 60. The conveyor will not start until the saw platform is in the "up" position to close contacts 3 and 4 of switch 96. Contacts 3 and 4 of switch 92 are broken when the pusher platen extends and the rod 91 engages the contact arm of switch 92. Until the pusher platen is reversed contacts 3 and 4 of switch 92 remain open and will not allow the conveyor to start until the pusher platen has retracted to its initial position as illustrated in FIGS. 1 and 2. A manual delay switch 101 may be used if desired. As an added precaution, if the saw and saw platform are in the "down" position but the piston of cylinder 87 and the pusher plate attached thereto are not fully retracted so as to allow projection 94 to close contacts 1 and 2 of switch 90, the circuit to hydraulic valve 98 will be interrupted and will not allow the ram to be activated to advance the pusher plate.

The chain saw is lowered by allowing hydraulic fluid in cylinder 60 to flow through an adjustable flow control valve. The weight of the saw and platform forces the hydraulic fluid from the cylinder through the adjustable flow control valve allowing the saw to descend against the log held in place for cutting. Closure of switch 77 activates the chain saw motor as well as opening the flow control valve. When the timber falls into trough 81 freeing limit switch 77, this activates hydraulic ram 87 secured to the pusher plate 84 which rams the cut log resting in the V-shaped trough against splitter blade 85 to split the timber into two halves. When the projection 93 on rod 91, contacts the arm of limit switch 89 it causes the hydraulic ram 87 to reverse and retract the pusher plate 87 to its initial position.

The operation cycle continues until the entire length of timber has been sawn and split. Additional timber may be loaded onto the conveyor as the previous timber is fed into the machine. As the timber is split by the splitting blade 85 it is advanced along an extension of the trough to a stacking or use location which may be a flat bed truck or other means by the pusher plate.

One man can operate the unit and can cut and split up to 2½ to 3 cords of wood an hour utilizing the equipment illustrated and described. The equipment is compact, portable efficient linear system which is fully automated.

I claim:

1. An automated apparatus for cutting and splitting timber and conveying the split timber to a storage or use location comprising:

intermittent conveyor means for supporting and intermittently advancing the timber to be cut a predetermined measured length beyond the cutting station, cutting means at the cutting station for cutting the timber advanced to the cutting station, a trough beneath the cutting station for receiving the cut timber, a vertical splitting blade positioned in the path of the timber in the trough downstream from the cutting means, a reciprocating hydraulic ram which engages and forces the cut timber falling into the trough from the cutting station against the vertical splitting blade to split the timber into two pieces and advance previously split timber to the storage or use location, and control means for automatically (1) controlling advance of the timber to the cutting station to be cut, (2) activating the cutting means with the timber in the cutting station to cut the timber and (3) activating the reciprocating hydraulic ram after the timber is cut to force the cut timber resting in the trough against the vertical splitting blade to split the timber, the control means including sensing means mounted adjacent the cutting means for sensing the predetermined measured length of the timber being conveyed into and past the cutting station by the conveyor means, means responsive to the sensing means operatively connected to the conveyor means and cutting means to stop the conveyor means and activate the cutting means at the cutting station to cut the timber, means cooperating with said cutting means for sensing the completion of said cut and means responsive to said last mentioned sensing means for activating the reciprocating hydraulic ram to split the cut timber.

2. The apparatus of claim 1 wherein the cutting means has an essentially constant width over its length.

3. The apparatus of claim 2 wherein the width of the splitting blade is about ⅜ of an inch.

4. The apparatus of claim 3 wherein the means for cutting the timber is a hydraulically driven chain saw.

5. The apparatus of claim 1 including hold-down means for holding the timber against the conveying means as it is intermittently advanced into the cutting station.

6. The apparatus of claim 5 wherein the hold-down means includes a hold-down wheel which engages the upper surface of the timber being conveyed and a pneumatic cylinder whose piston is secured to the hold-down wheel, the wheel being free to adjust vertically to the irregularities in the timber being conveyed along the conveying means into the cutting station.

7. In an apparatus for sawing and splitting timber having a frame, conveying means on the frame for supporting and conveying the timber to be cut into a cutting station; cutting means mounted on the frame at the cutting station adjacent the conveying means for cutting the timber at measured intervals; and splitting means including a splitting blade mounted on the frame downstream from the cutting station for splitting the cut timber, the improvement comprising:

control means for automatically operating the conveying means, cutting means and splitting means in timed sequence, the control means including sensing means mounted adjacent the cutting means for sensing a predetermined measured length of the timber being conveyed into and past the cutting station by the conveying means, means responsive to the sensing means operatively connected to the conveying means and cutting means to stop the conveying means at such predetermined measured length and activate the cutting means at the cutting station to cut the timber, means cooperating with said cutting means for sensing the completion of said cut and means responsive to said last mentioned sensing means for activating the splitting means to split the timber.

8. An apparatus for measuring, cutting and splitting timber and transferring the split timber to a stacking location, comprising:

a frame, intermittent conveying means mounted on the frame for supporting and conveying the timber to be measured and cut, a powered chain saw pivotally mounted to the frame to swing between an upper position allowing the timber to be conveyed beneath it and a cutting position for severing the timber, power means operatively connected to the chain saw controlling raising and lowering thereof, a V-shaped trough extending forward of and beneath the chain saw relative to the conveying means for receiving the cut timber, a splitting blade mounted in the V-shaped trough in the path of the cut timber and forward of the chain saw a distance equal to at least the length of the timber being cut for splitting the timber into at least two parts, a movable pusher plate normally positioned at the end of the V-shaped trough beneath the chain saw, a hydraulic ram mounted on the frame having its piston secured to the pusher plate for forcing the pusher plate against a cut timber resting in the V-shaped trough to force the timber against the splitting blade, sensing means mounted on the frame a measured length from the cutting means corresponding to the desired cut length of the timber for sensing the length of the timber being conveyed past the chain saw to a cutting position, and control means cooperating with the sensing means to automatically sequentially (1) stop the conveying means, (2) activate the power means to lower and start the chain saw, (3) raise and stop the chain saw, (4) activate the hydraulic ram to force the cut timber in the V-shaped trough against the splitting blade, and (5) activate the conveying means to advance the timber a measured amount to the cutting position.

9. The apparatus of claim 8 wherein the width of the splitting blade is about $\frac{3}{8}$ of an inch and has an essentially constant width over its length.

10. The apparatus of claim 8 including a hold-down wheel which engages the upper surface of the timber being conveyed and a pneumatic cylinder secured to the frame having a piston secured to the hold down wheel, the hold down wheel being free to adjust vertically to the irregularities in the timber being conveyed by the conveying means to the cutting position.

* * * * *